United States Patent [19]

Sauvage

[11] 4,112,548

[45] Sep. 12, 1978

[54] DRAFTING MACHINE

[76] Inventor: Joseph Sauvage, Avenue de Parc, 57, 4920 Embourg, Belgium

[21] Appl. No.: 725,668

[22] Filed: Sep. 22, 1976

[30] Foreign Application Priority Data

| | | | |
|---|---|---|---|
| Sep. 23, 1975 | [BE] | Belgium | 645181 |
| Jul. 9, 1976 | [BE] | Belgium | 645597 |
| Dec. 4, 1975 | [BE] | Belgium | 645280 |

[51] Int. Cl.[2] ..... D01H 5/00

[52] U.S. Cl. ..... 19/243; 19/258; 19/294; 19/272

[58] Field of Search ..... 19/258, 294, 150, 272, 19/243

[56] References Cited

U.S. PATENT DOCUMENTS

| | | | |
|---|---|---|---|
| 2,219,666 | 10/1940 | Solanas | 19/258 X |
| 2,410,020 | 10/1946 | Lathauwer | 19/243 |
| 2,793,400 | 5/1957 | Kempe | 19/272 |
| 2,885,740 | 5/1959 | Thompson et al. | 19/294 X |
| 2,922,198 | 1/1960 | Barrett | 19/294 X |
| 3,063,101 | 11/1962 | Andreani | 19/243 |
| 3,067,471 | 12/1962 | Nodo | 19/243 |
| 3,071,824 | 1/1963 | Eberle | 19/258 |
| 3,224,181 | 12/1965 | Johnson | 19/243 X |
| 3,327,356 | 6/1967 | Andreani | 19/243 |
| 3,479,700 | 11/1969 | Livingston | 19/258 X |
| 3,988,807 | 11/1976 | Veda et al. | 19/258 |

FOREIGN PATENT DOCUMENTS

| | | | |
|---|---|---|---|
| 1,038,465 | 3/1952 | Fed. Rep. of Germany | 19/272 |
| 5,869 | 5/1963 | Japan | 19/243 |
| 710,153 | 1/1954 | United Kingdom | 19/258 |
| 463,447 | 3/1937 | United Kingdom | 19/243 |

*Primary Examiner*—Mervin Stein
*Assistant Examiner*—Andrew M. Falik
*Attorney, Agent, or Firm*—Martin A. Farber

[57] ABSTRACT

A machine for blending, matting, shortening or sizing natural or artificial fibers, in which the work is performed by groups or trains of three rollers. A first working stage has a single head delivering two slivers and in which the twin bearing rollers are of large size, the two slivers emerging from the single head being fed axially or perpendicularly by directional and juxtaposing members towards a second working stage in a single lap, the width of which is at least 50% less than the width of an individual sliver. The second working stage has a reducing head which comprises a plurality of trains with twin lower retaining and traction rollers, respectively, mounted overhung on frames, adjustably spaced from one another.

24 Claims, 16 Drawing Figures

1
2
3

1
2
8
3
R
10
7
6
6
F
F
5
R
4

16
11
12
13
14
15
16
17
11
17
12
18

13
14
18
17
17
18

16
11
17
18
19
20

11
17
18
19
20

FIG.9
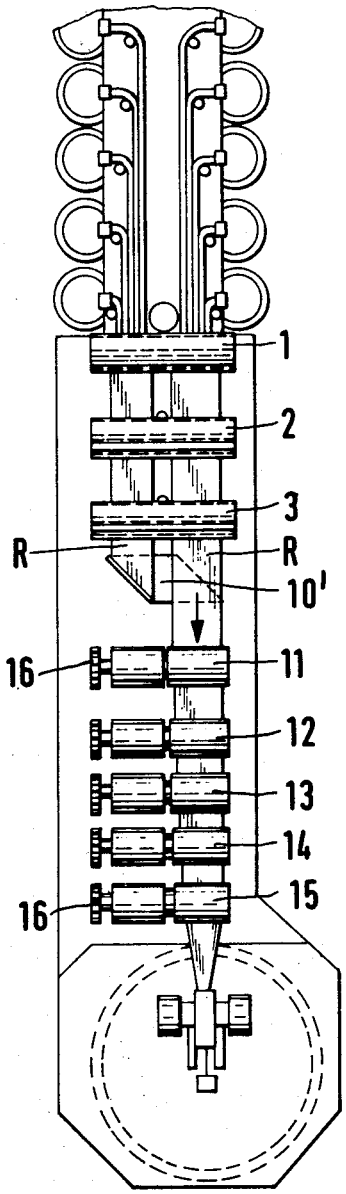
FIG.10
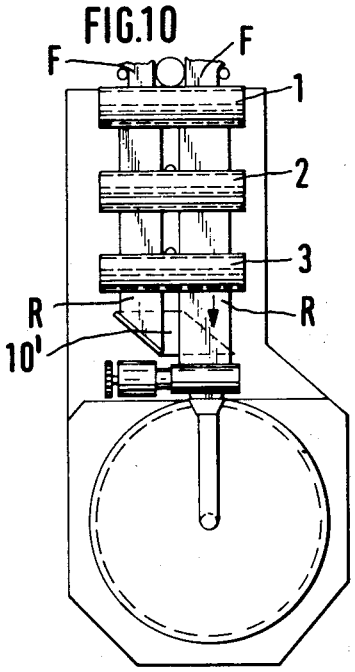
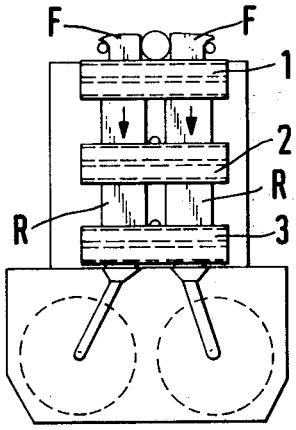
FIG.11

DRAFTING MACHINE

FIELD OF THE INVENTION

The present invention relates to the operations of converting fibres, and of blending, breaking or grading of slivers of natural or artificial fibres, operations hitherto performed on machines referred to as blenders, converters or breakers.

BACKGROUND OF THE INVENTION

The known machines which are referred to as blenders are machines having two twin heads, each of which blends together eight to 14 slivers of fibres emanating either from a dyeing stage, or machines for breaking or converting continuous cables into discontinuous fibre slivers. Sometimes, both heads work by providing a bar movement during drawing, between supply rollers and what are known as drawing rollers, in order to control progressive retention of the fibres during drawing. In another application, it has been noted that the drawing operation, the main object of which is to break open or blend the greatest possible number of components, takes place most easily although imperfectly, between trains of three rollers, the number, speed and spacing of which have been judiciously established according to the fibre length diagram. As stated earlier, two heads are used in a twin disposition in order to increase to the maximum the number of "doublings", in order to combine them into a single sliver in a second drawing stage provided with a sleeve or cylinder control system referred to as a reducer or grader, which will receive the two juxtaposed slivers upon their separate emergence from each head.

Known single-head machines, composed of groups of three rollers an upper pressure roller and thereafter two twin carrier rollers for maintenance and control, respectively, are adapted to reconvert excessively long fibres obtained from the "converter", while others reconvert or convert discontinuous slivers of fibres, to make them of a length referred to as a "cotton length", that is to say up to 40 m minimum length, nowadays mainly adapted for Open End spinning.

In the known blenders referred to above, it is difficult to set the two twin heads identically.

The second connected drawing stage combining the two slivers obtained from the head described above acts on a mass of fibres which is greatly reduced in weight by prior drawing processes, so that by necessarily rendering it narrower, it will ocupy only one-third the width of a conventional head.

The difficulties arising during passage of a mass of material to be treated through a single head reconverting machine are well known: it is impossible adequately to narrow the lap even with condensers set increasingly closer to one another between the four, five or six successive trains, so that the emerging sliver is so thin that it becomes wound around the delivery rollers, preventing high speed delivery.

SUMMARY OF THE INVENTION

The object of the invention is to remedy the drawbacks of the known machines and to replace existing drawing frames such as those described above with one and the same single machine for the first phase of breaking, blending or converting produced previously on twin heads of the comb or roller type, while for the second phase of drawing on what is known as a reducer head, it is possible to provide rotary combs or suitable roller devices, to be explained according to the invention. This head may also be designed to carry out reconversion by varying the diameter of the rollers according to the length of the fibres to be obtained.

The machine according to the invention for two-stage blending, breaking, converting or grading natural or artificial fibres comprises a first head, identical in every case, the working width of which corresponds approximately to that of the two conventional twin heads, taking into account the ruggedness of the rollers, and the twin carrier rollers of each train are of a large size, on the order of 60 to 70 mm in average diameter.

In a machine according to the invention, the reducer head is expressly narrower, thus condensing the material more intensely, facilitating treatment of the fibres which become progressively shorter, while this lighter but more condensed sliver permits of more rapid delivery.

Likewise in a machine according to the invention, the single, less expensive head replaces the two twin heads, whereby movable frames connected by a tie-member and operated by threaded screws and moving on two guide spindles, permit easier working.

Again according to the invention, the reducer head provided for the various applications has its rollers or other members overhung, ensuring easier accessibility.

Beside a machine in which work is performed in two phases and in which the web of slivers (hereinafter called slivers) coming from the first head are directed towards the second phase after having described an angle of 90°, the invention is likewise characterised in that in the machine of the second phase, the slivers continue to advance in the direction of the first head.

It has likewise been found that each of the two phases of the machine may constitute an individual machine.

In a single or two-phase drawing machine, it is proposed to provide the twin rollers with pronounced helical flutes so that they can draw considerable masses of fibres. In cotton spinning, drawing is performed perfectly between rollers only and not via combs. It was impossible hitherto to apply this process to long fibres, because the gripping and holding means lacked attachment means such as larger diameter of rollers, absence of marked parallel or pronounced helical fluting, high pressures and mechanical means making it possible to accurately regulate the distances between trains as in the case of cotton drawing, and even more accurately than the latter. By reason of the invention, it will now be possible to draw considerable masses of long fibres.

In a first train of three rollers it is proposed, to control the bottom two twin rollers to maintain the mass of fibres absolutely in contact with the upper roller, while one of the bottom rollers is designed to make it possible for the fibres to slide when it is gripped by a following drawing train, this sliding effect being obtained by conical or trapezoidal circumferential grooves provided in the bottom roller.

In order to avoid any slipping of the fibres on the first roller, it is proposed to resist the traction from the following train by providing on the periphery of the first of the twin rollers, saw tooth or sharply pointed ridges, an arrangement which will moreover diminish the risks of winding on.

In the case of a machine having more than two trains the second drawing train, which receives a mass which is greatly diminished by the previous drawing operation, comprises a second roller with shallower circular grooves which are closer together.

It is further proposed to allow adjustment of the gap between two bottom cylinders according to the length of the fibres to be drawn.

When drawing particularly short fibres or light slivers it is advantageous to provide a smaller diameter top roller for the last train which approaches the diameter of the fluted bottom roller in the preceding train when said roller is being used as a control roller.

There is likewise provision for making fluted, so-called "control" rollers of steel, in a single piece, yet also of discs set closely one beside another on a shaft of adequate diameter to ensure rigidity. These discs, which will finally form the roller, may be of metal or of any other material.

A machine produced according to the invention is used in the blending and breaking of any kind of fibres, in spinning and dyeing, worsted or synthetic. Its application is proposed in "tow-to-top" for blending and smoothing of polymerized or retracted slivers. Its use is also particularly proposed in obtaining short fibres for the "open end" system and for cotton spinning.

BRIEF DESCRIPTION OF THE DRAWINGS

In order that the invention may be the better understood, it is now described with reference to the attached drawings, which are intended purely as examples, and in which:

FIG. 9 is a plan view of the machine according to the invention set up for reconversion, in which the second working phase is disposed as an extension of the first;

FIG. 10 is a plan view of a machine comprising only the first phase of the machine shown in FIG. 9;

FIG. 11 is a view similar to that of FIG. 10 but producing two slivers instead of one;

FIG. 12A is a view similar to FIG. 12, but showing a variant thereof;

FIGS. 13A and 13B respectively are views similar to FIG. 13 but of the variant rollers of FIG. 12A.

DETAILED DESCRIPTION OF PREFERRED EMBODIMENTS

Figures 1, 2, 3, 4, 5, 6:
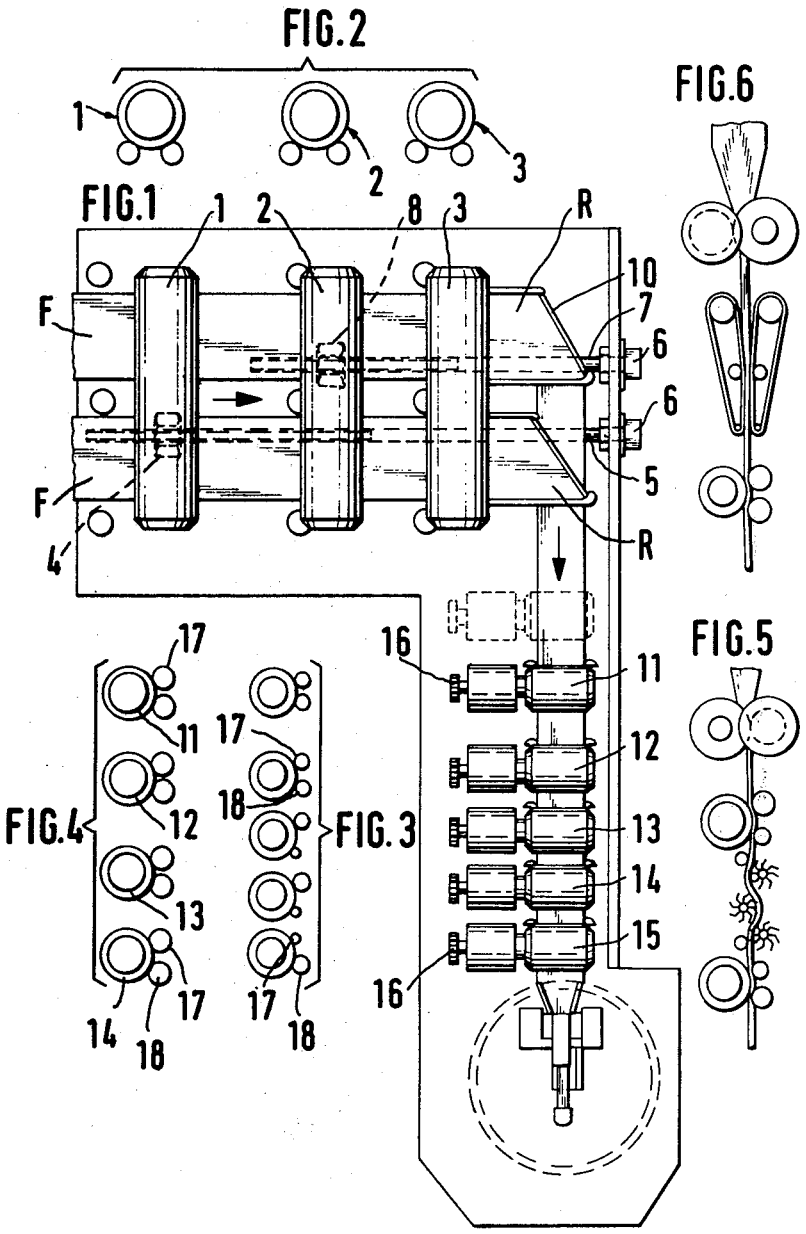
FIG. 1 is a plan view of a breaker-blender-converter for short fibres.
FIG. 2 is a side view of the trains in the single head.
FIG. 3 is a view similar to that of FIG. 2 showing the trains in the reducer head.
FIG. 4 is a view similar to that in FIG. 3, applied to the reconversion of longer fibres but as a single reducer when there are only two trains and then operating as a blender as shown in FIGS. 5 and 6.

FIG. 1 shows that the two webs of slivers F emanating respectively from each side of the creel, not shown in the drawings, end at a single head comprising three trains 1, 2, 3, although it is possible obviously to increase or reduce the number of trains.

The total width of the working part is approximately twice that of the existing heads, so that the total intake capacity of this head may rise to 700 r.p.m. in view of the ruggedness of the twin carrier rollers of the trains, and of which at least one is heavily fluted.

Figures 7, 8:
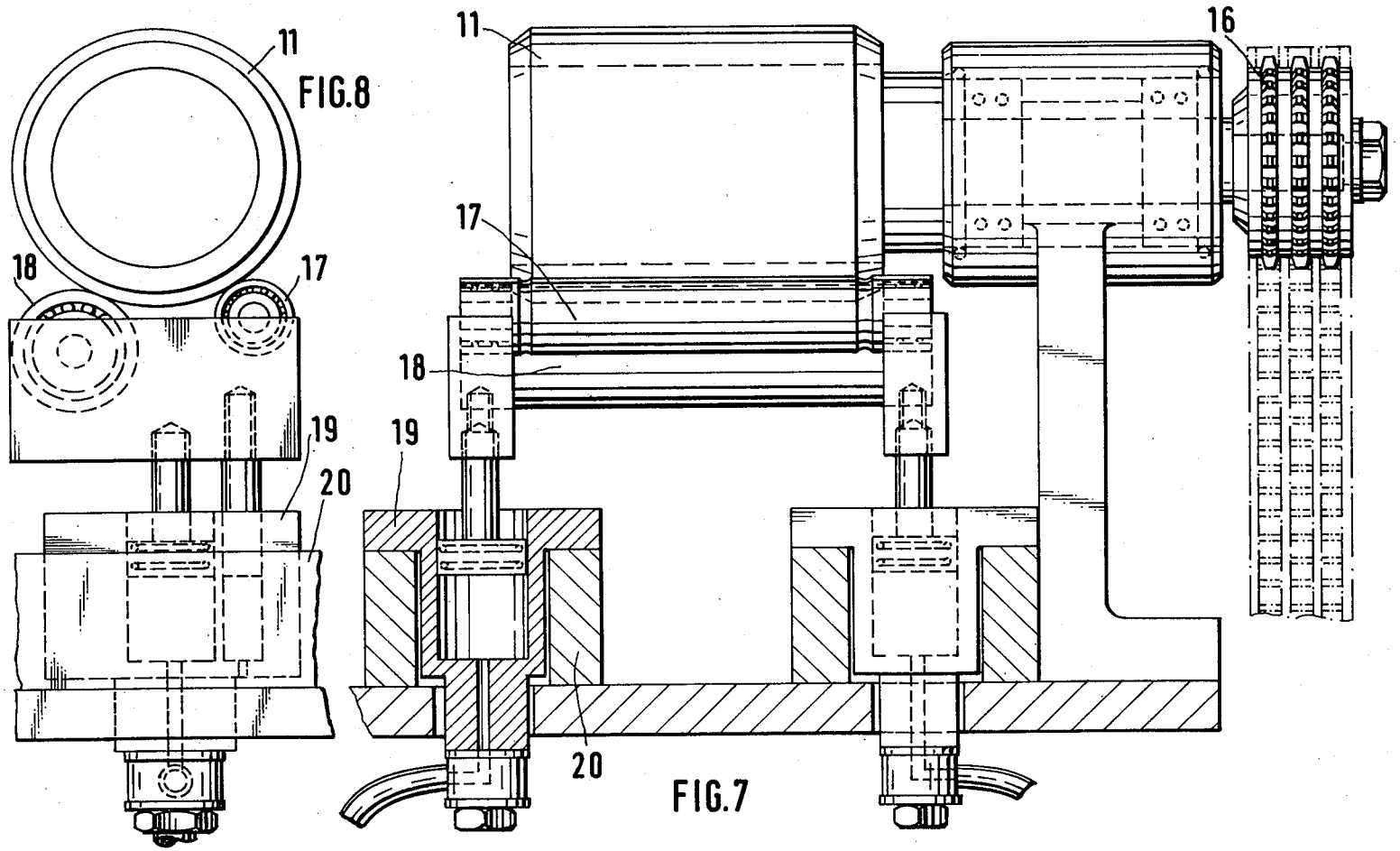
FIGS. 7 and 8 respectively show front and side views of a train in the the reducer head.

Inserted into a nut 4 fixed to the train 1, made in one piece and well guided, is a screw with a strong thread 5, of which the squared end 6 projects externally of the machine, although this screw can be operated from inside the machine by a permanently fixed hand wheel, the ratchet of which operates the threaded screw operatively attached to the box-like support for the rollers 17 and 18 (FIG. 8). Operation of the hand wheel jointly moves the bottom rollers only, of this first train in accordance with a graduated disc or millimeter graduated scale.

The second train 2 is operated by a similar screw 7 acting on the nut 8 fixed to this train and controlled according to the means described hereinabove.

The third train 3 may be fixed.

The two emerging slivers R are then returned via guides 10, the angle of inclination of which is chosen in such a way as to diminish the width of the lap by more than half, thus increasing its final thickness and cohesion.

The lap then arrives at the head which reduces the mass or length according to the result desired. FIG. 7 shows a pinion drive with a chain 16, presser rollers 11 to 15 overhangingly mounted, although this is only one of many means and with support bearing rollers (unnumbered) illustrated between the chain 16 and the presser rollers 11 (also note FIG. 7 upper right), which support the presser rollers which are mounted overhangingly.

In this case, two twin idle rollers 17, 18 (also called "idle rollers" since they are pressed against the upper roller), situated below each presser roller and the ball-bearing mounted ends of which are located in housings, are pressed upwards by hydraulic pressure, as can be seen in FIGS. 7 and 8.

In another embodiment, it is possible to limit the number of trains to two, but often it comprises three trains of three overhung rollers.

In the detail shown in FIG. 7, it can be seen that the pressure cans 19 are free and easily movable on slideways 20, being self-locating vertically when pressure is applied.

All the rollers of this second phase may be fluted, milled or simply smooth and conform in diameter and fluting to those of the first head, even if limited to two trains.

The diameters of the various rollers and their spacing in the case of reconversion of fibres are progressive. For example, in the drawing stage the diameters have been chosen for short fibres intended for cotton or "open end" spinning, but the twin rollers driven by the roller which is coated by elastic material may have the same or different diameters.

FIGS. 2 and 5 symbolize applications in different cases.

FIG. 5 shows a characteristic circular comb or pin-wheel arrangement.

FIG. 9 shows the same machine as that which is illustrated in FIG. 1, but here the slivers R continue to advance in the direction of the first head, that is the second head is located in an extension of the first. As in the machine shown in FIG. 1, the two slivers R are combined into one but here again it is as a result of the double reversal of direction of just one of the slivers over a direction changing means such as a plate 10'.

Shown in FIGS. 10 and 11 is a machine comprising only the first phase. In FIG. 10, the reversing plate, having a double angle 10' allows slivers R to be juxtaposed before the canning or curling of a single sliver. In FIG. 11, the single head works as an individual machine producing two slivers. The twin carrier rollers of the trains are provided with pronounced flutes, which are helical or at right-angles to the roller axis, so that it is possible perfectly to control the material, and the wool and synthetic fibers can be treated together as on an intersecting arrangement. The precise adjustment of the spacings is achieved by reason of the aforedescribed control device which controls the movement of the heads.

Figure 12:
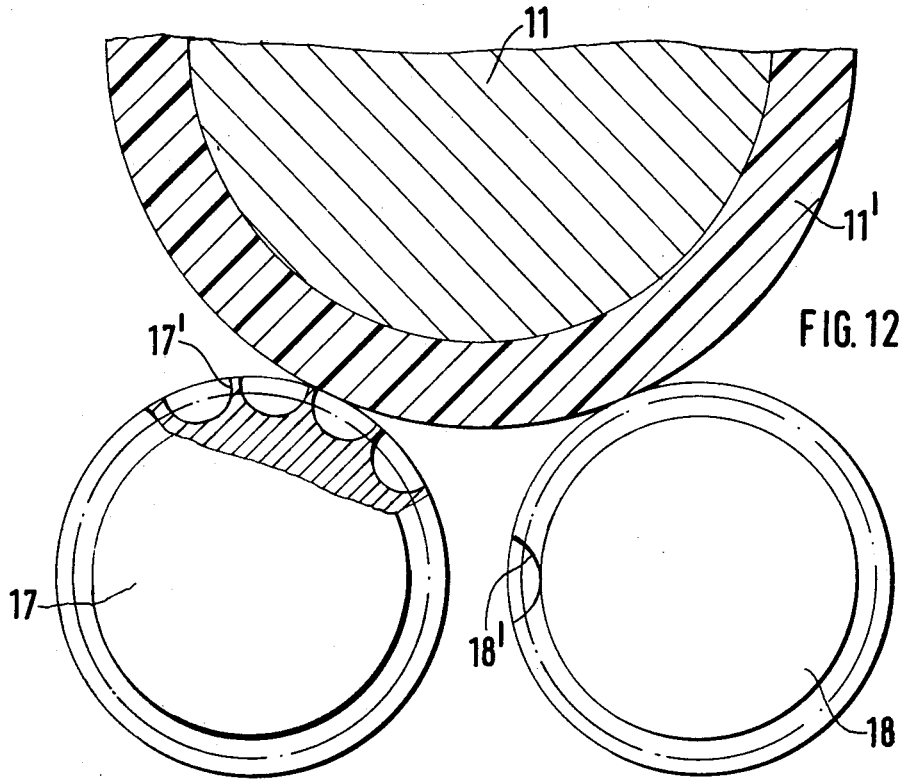
FIG. 12 is a section through a three-roller drawing assembly.

FIG. 12 shows a section through a three roller drawing assembly. The roller 11, provided with an elastic covering 11' is applied by hydraulic or other pressure against the two fluted twin rollers 17 and 18.

Figure 13A:
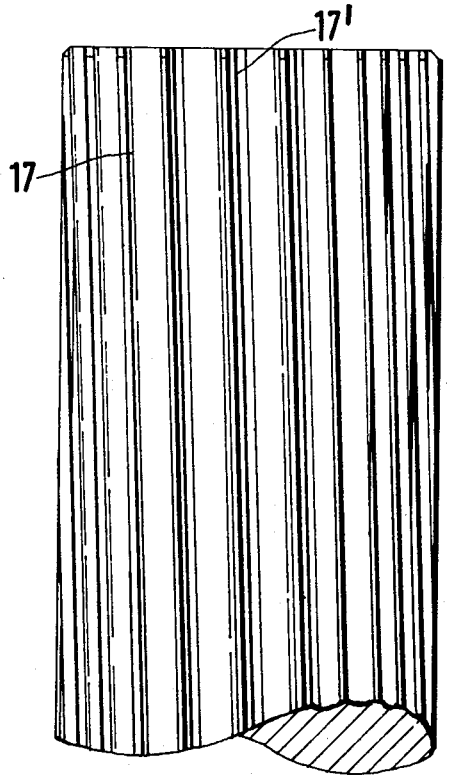
FIGS. 13*a* and 13*b* are partial views of fluted rollers showing various forms of fluting.

The first roller 17 of the first train, if there are three trains following one after another, has a fluting 17' which is very slightly helical, while the second 18 has a spiral fluting 18', the turns of which are far more inclined in respect of the axis (bordering on 45°) and in the opposite direction (FIG. 13*a*).

On the roller 17, the flutes 17' are helical in order to avoid violent pulls on the presser roller. The flutings 18' on the roller 18 are inclined in the opposite direction to the flutings 17' in order as far as possible to avoid the lap from slipping off on one side.

The fluting on the roller 18 has a more defined spiral in order to break down bunches of agglomerated fibres, as a result therefore of the distributed gripping of the fibres. It is thus desirable for drawing to be extended somewhat towards the roller 17 in order to improve regularity, hence the second roller 18 may have grooves parallel and at right-angles to the axis (FIG. 12).

Figure 13B:
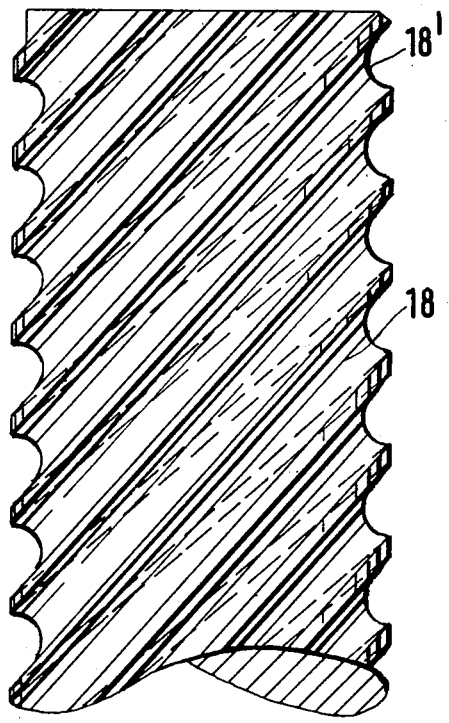

The shape of the fluting will be appropriate to the work envisaged. Three types of fluting are shown as being provided on the roller 18 in FIGS. 13b, 13A, 13B. It must however be stipulated that the squared form of the fluting which can be provided on the roller 18, properly trued after tempering, is entirely suitable for cutting or shortening any type of synthetic fibre slivers. In this latter case, the presser roller is advantageously free of elastic covering; it is made of smooth steel or may have straight or helical channels cut into the mass of the roller or not, as the case may be.

Figure 14:
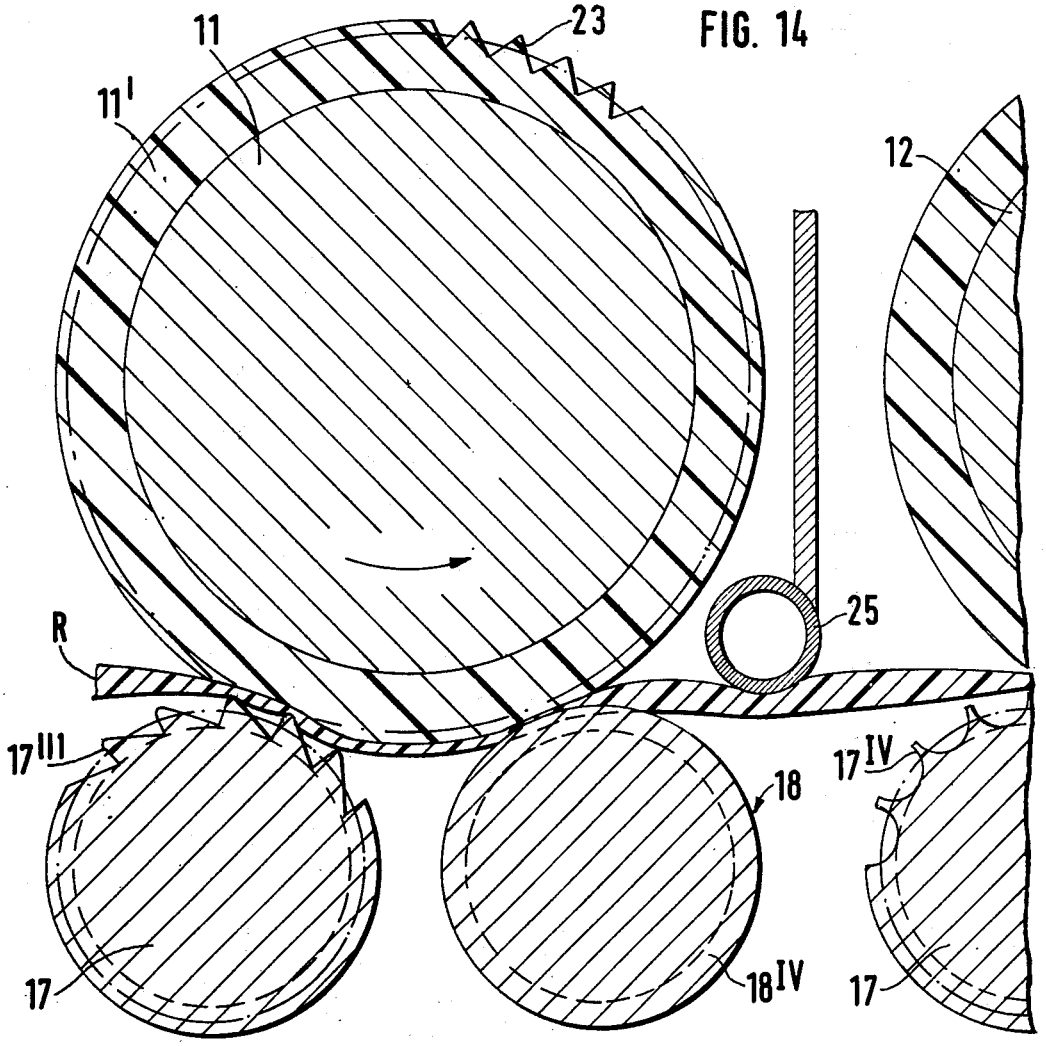
FIG. 14 shows a section through an alternative train or through the roller drawing assembly.
Figure 15:
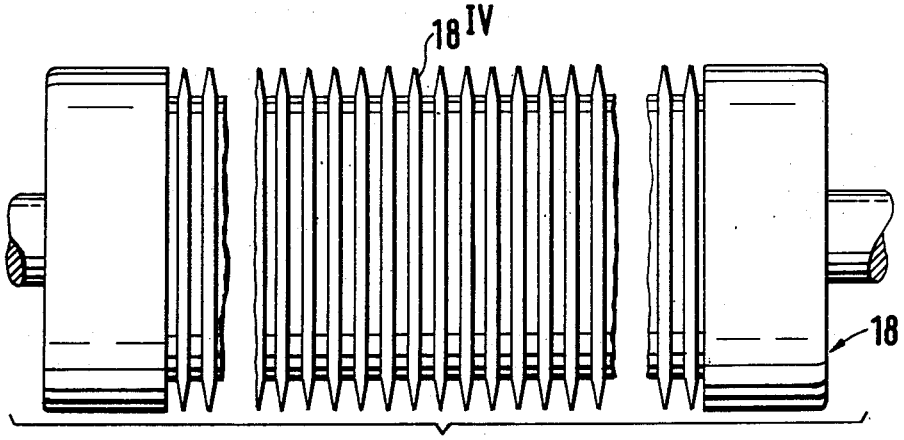
FIG. 15 is a plan view of a control roller of the train shown in FIG. 14.

FIG. 14 shows an alternative arrangement of the three rollers in a train without limiting the application of each separate element to the following train or trains. A mass of fibres R, distributed as thoroughly as possible over the intake creel, is brought towards the first free roller drawing train shown in FIG. 15.

The presser roller 11, usually covered with elastic material 11', may according to the considerable mass of fibres on intake, be made entirely of steel and may, or need not have fluting of various forms such as flutings 23 or 24.

The material is pressed by a hydraulic, pneumatic or mechanical system against the twin rollers, roller 17 for maintenance or support and roller 18 for control purposes.

The roller 17 has deep channels $17^{III}$ cut therein shown here in saw tooth profile, in order better to withstand the traction effected on the fibres by the second train (shown to the right in FIG. 14 with the grooves $17^{IV}$ — the second train including rollers 12, 17 and 18, the latter roller not shown — a train as previously indicated constituting a group of three rollers, namely an upper pressure roller and two lower rollers for maintenance or support and control, respectively). By virtue of the saw-tooth profile of the roller 17.

The roller 18 is now adapted to constitute a sliding control element, by reason of the fact that this roller has circular and parallel trapezoidal grooves ($18^{IV}$ FIG. 14) over its entire working width and a smooth portion can be formed on each side or possibly in the center of the rollers for supporting the presser roller when the machine is running under no load conditions.

A regulatable depression means 25 bears at will on the emerging lap in order to regulate the automatic control of the fibres inter se as a function of their volume. It may be cylindrical and rotating and may have grooves parallel with its axis.

The material pulled by the second train will be positively gripped between its presser roller 12 and its supporting roller 17, which is provided with deep flutes; however the control roller (not shown), like the roller 18 of the first train, will be provided with grooves which are circular but which are of a smaller width, as a function of the forming of the lap due to the preceding drawing operation. If the head comprises only two trains, the second roller will be simply smooth or channelled.

For its part, the regulatable depressor 25 will be adjusted similarly in its height; it may be provided with parallel grooves like the roller 18 or it may possibly be smooth and/or rotary, in order that the following roller provides regular drawing, due to this additional control. This control element may have an appropriate profile, such as semi-circular or flat.

The last train (e.g., in FIG. 1 represented by upper roller 15) may have its control roller of a smaller diameter in order further to reinforce its control ability in the treatment of short fibres.

The apparatus described hereinabove is intended for the treatment of long fibres, but by reducing the diameter of the various rollers and the amounts of which they are spaced apart, proportionately, it is possible also to draw short fibres.

In the first train the presser roller is made of steel and has flutes instead of being covered with an elastic coating, and it may constitute two pieces each oscillating about its single roller- or ball-bearing.

I claim:

1. A machine for blending, matting, shortening or sizing natural or artificial fibers, comprising a first and second working stage, each of said stages comprising a plurality of trains of rollers adapted to perform work, each of said trains consisting of three rollers including an upper presser roller and two twin carrier rollers under said presser roller, said plurality of trains including at least one single head and including said twin carrier rollers of large size constituting said first working stage, and said second working stage sequentially operatively arranged relative to said first working stage, said single head comprising means for delivering at least two separated webs of slivers of fibers therethrough, means for forming a narrow thick lap constituting directional juxtaposing members for feeding the two separated webs emerging from said single head along a horizontal plane towards said second working stage in a combined single lap having a width at least 50% less than the width of an individual of said two separated webs, said second working stage including a reducer head comprising a number of said trains, including frames and a twin lower supporting roller and control roller, respectively, overhangingly mounted on said frames, adjustably spaced from each other.

2. The machine according to claim 1, further comprising means for regulating the spacing of said trains from each other comprising a frame part and a drive screw rotatably mounted in said frame part, a nut integral to one of said trains, said drive screw is screwed longitudinally moveably in said nut and is adapted to be turned for adjustment, two spaced slideways oriented perpendicularly to the axis of said carrier rollers and parallel to said drive screw, moveable members supporting said lower twin carrier rollers, said moveable members are moveably mounted in said slideways.

3. The machine according to claim 1, wherein said directional juxtaposing members constitute inclined plane means for combining the two separated webs into the single lap and reducing the slivers by at least half the width of the individual separated webs prior to the single lap being directed towards said second working stage.

4. The machine according to claim 1, wherein said second working stage is horizontally linearly arranged with respect to said first working stage along a linear extension of the direction of movement of the individual separated webs through said first working stage, such that the single lap is thereby directed longitudinally to said second working stage from said first working stage.

5. The machine according to claim 4, wherein said first working stage has an outlet, one of the webs is juxtaposed with the other web to form the single lap via said directional juxtaposing members, the latter includes a double angle direction reversing means twice reversing the direction of one of the webs into the other web and for causing the single lap composed of the juxtaposed webs to continue to move in the same linear direction as that of the individual slivers while in said first working stage.

6. The machine according to claim 1, wherein said second working stage is horizontally and perpendicularly arranged with respect to said first working stage perpendicular to the direction of movement of the individual separated webs through said first working stage, such that the single lap is thereby directed perpendicularly to said second working stage from said first working stage.

7. The machine according to claim 2, wherein said two twin carrier rollers in each of said trains are mounted idling on said moveable members, pressure means disposed in said moveable members for subjecting said two twin rollers to hydraulic pressure from below, and for vertically self-locatingly fixing the latter in position cooperatively toward a corresponding of said presser rollers upon being subjected to pressure.

8. The machine according to claim 1, wherein one of either said first or second working stages constitutes a drawing frame, one of said twin carrier rollers of one of said trains of said drawing frame constitutes a second twin roller serving as a control roller formed with grooves oriented substantially at right angles to the axis of said second twin roller, and the other of said twin carrier rollers constitutes a first supporting roller formed with deep flutes, said first and second twin rollers respectively are arranged sequentially in the direction of movement of the lap, a second of said trains of said drawing frame sequentially follows said one train in the direction of movement of the lap, said second train gripping the lap whereby the lap is permitted to slide by said second twin roller of said one train during a drawing operation, while said deep flutes of said first supporting roller prevents sliding.

9. The machine according to claim 8, wherein said twin rollers are formed with deep flutes oriented helically relative to the axes of said twin rollers.

10. The machine according to claim 8, wherein said twin rollers are formed with deep flutes oriented perpendicularly relative to the axes of said twin rollers.

11. The machine according to claim 8, wherein said twin rollers are formed with deep flutes of rectangular shape with sharp edges.

12. The machine according to claim 11, wherein said presser roller corresponding to said twin rollers is made of steel and has parallel channels formed therein.

13. The machine according to claim 12, wherein said control roller is formed with circular grooves disposed adjacent one another over an entire working surface width thereof constituting a sliding control element.

14. The machine according to claim 8, wherein said control roller is formed smooth in a portion thereof constituting a means for supporting said presser roller under no load conditions during operation.

15. The machine according to claim 13, wherein said control roller includes a plurality of discs disposed closely adjacent one another.

16. The machine according to claim 8, wherein said supporting roller is formed with saw-tooth flutes.

17. The machine according to claim 8, wherein said first supporting roller is formed with an oblique flute oriented at a slight acute angle of inclination relative to the axis thereof, said second twin roller is formed with a flute spiraling in an opposite direction relative to said oblique flute of said first supporting roller and oriented at an angle of inclination substantially more inclined than the angle of inclination of said oblique flute of said first supporting roller.

18. The machine according to claim 8, wherein said presser roller of a first of said trains is made of steel and formed with flutes and two separate pieces.

19. The machine according to claim 18, wherein said control roller is idlingly mounted and operatively driven by contact with said presser roller, and a spacing defined by said control roller is adapted to be regulated depending on the length of fibers to be worked.

20. The machine according to claim 8, wherein one of said trains constitutes a last train, one of said twin carrier rollers of said last train constitutes a first twin roll and the other of said twin rollers constitutes a last twin roller in the direction of movement of the lap, said first twin roll has a diameter substantially smaller than that of said second twin roller.

21. The machine according to claim 8 further comprising a rotating adjustable roller means for depressing said lap into said spaces between said trains for improving control of the lap without preventing sliding thereof, said control roller defines an outlet thereof, said rotating adjustment roller is disposed adjacent the outlet of said control roller.

22. A machine according to claim 1, working as a drawing machine, characterised in that each of the two working stages constitutes an individually operating machine.

23. A machine for blending, matting, shortening or sizing natural or artificial fibers, comprising at least one single head comprising a plurality of trains of rollers adpated to perform work, each of said trains consisting of three rollers including an upper presser roller and two twin carrier rollers under said presser roller, said plurality of trains including the twin carrier rollers of large size and constituting a first working stage, said at least one single head including means for delivering at least two separated webs of slivers therethrough, means constituting directional juxtaposing members for feeding the two separated slivers emerging from said single head along a horizontal plane in a combined single lap having a width at least 50% less than the width of an individual of said two separated slivers forming a narrow thick lap.

24. The machine according to claim 23, further comprising a second working stage, said directional juxtaposing members comprise inclined plane means for combining and narrowing the at least two separated webs emerging from each of said at least one single head and such that the lap thus formed and automatically narrowed is directed towards said second working stage, said second working stage constitutes drawing elements.

* * * * *